US010926185B1

(12) United States Patent
Pihl

(10) Patent No.: US 10,926,185 B1
(45) Date of Patent: Feb. 23, 2021

(54) TOY BUILDING BLOCKS

(71) Applicant: PLUS-PLUS A/S, Holbæk (DK)

(72) Inventor: Jens Martin Pihl, Holbæk (DK)

(73) Assignee: PLUS-PLUS A/S, Holbaek (DK)

( * ) Notice: Subject to any disclaimer, the term of this patent is extended or adjusted under 35 U.S.C. 154(b) by 0 days.

(21) Appl. No.: 16/590,727

(22) Filed: Oct. 2, 2019

(51) Int. Cl.
*A63H 17/00* (2006.01)
*A63H 17/267* (2006.01)
*A63H 33/08* (2006.01)
*A63H 17/26* (2006.01)

(52) U.S. Cl.
CPC ..... *A63H 17/002* (2013.01); *A63H 17/262* (2013.01); *A63H 33/086* (2013.01); *A63H 33/088* (2013.01)

(58) Field of Classification Search
CPC ..... A63H 17/002; A63H 33/04; A63H 33/08; A63H 33/088
See application file for complete search history.

(56) References Cited

U.S. PATENT DOCUMENTS 1,935,542 A * 11/1933 Bursell ..... A63H 3/52 446/110
2,278,327 A * 3/1942 Ludwig ..... A63H 33/108 446/124
3,089,269 A * 5/1963 McKiernan ..... G09F 7/06 40/622
3,274,727 A * 9/1966 Werner ..... A63F 9/06 446/118
3,838,535 A * 10/1974 Larws ..... A63H 33/084 446/124
4,375,139 A * 3/1983 Chatani ..... A63H 17/26 446/471
4,375,351 A * 3/1983 Allen ..... E01C 19/40 404/114
4,813,904 A * 3/1989 Larws ..... A63H 33/088 446/118
4,861,307 A * 8/1989 Larws ..... A63H 17/262 446/95
7,374,468 B2 * 5/2008 Flodin ..... A63H 17/002 446/102
8,105,127 B2 * 1/2012 Heston ..... A63H 33/084 446/106
9,101,851 B2 * 8/2015 Habibi ..... A63H 33/04

* cited by examiner

*Primary Examiner* — John A Ricci
(74) *Attorney, Agent, or Firm* — Jones Robb, PLLC

(57) ABSTRACT

A building block system includes one or more building blocks and one or more wheels, each building block including a first elongate portion extending in a longitudinal direction, a second elongate portion extending in that longitudinal direction, an intermediate portion connecting the first elongate portion with the said second elongate portion at a middle position thereof, a first end portion extending in a transverse direction, perpendicular to that longitudinal direction, from the first elongate portion, at a side thereof opposite to the intermediate portion, and at a middle position thereof. A second end portion extends in that transverse direction, perpendicular to the longitudinal direction, from the second elongate portion, at a side opposite to the intermediate portion, and at a middle position thereof. It thus includes six protrusions and two voids, each void defined between an end of the first elongate portion and an end of the second elongate portion.

19 Claims, 12 Drawing Sheets

TOY BUILDING BLOCKS

FIELD OF THE INVENTION

The present invention relates in general to the field of toys. More specifically, the present invention relates in a first aspect and in a second aspect to a toy building block system. In a third aspect the present invention relates to a method for activation of children.

BACKGROUND OF THE INVENTION

For decades, toy building blocks have been available on the market. Toy building blocks represent elements of various geometrical forms and shapes which can be put to together in one or more ways so as to construct a final creation.

When a child makes the decision that he or she wants to build, say a house from a plurality of building blocks, the child will be intellectually challenged because he or she will have to figure out how a number of small building blocks can be put together in order to end up as something resembling a house. At the same time, the child will learn that putting effort into a project can lead to achievement of a result, and the child will feel the satisfaction of having achieved a result which he or she can admire and be proud of. Thereby, the child will also be taught that patience may be necessary before one can obtain the rewarding feeling of being proud of one's achievement.

Moreover, the child will experience training of motorically skills because he or she will have to coordinate the motions of his or her hands in order to put together the building blocks.

Accordingly, for these reasons, toy building blocks are considered to represent a valuable educational, intellectually stimulating toy which as the same time aids in training small children's fine motorically skills.

A vast variety of toy building blocks are known. These range from types of building blocks being present in a single geometrical shape only to being present in a few slightly modified geometrical shapes. Other types of toy building blocks comprise a system of building blocks which exist in hundreds or even thousand different geometrical shapes.

An example of the latter type of toy building blocks is Lego®. Examples of the former type of building blocks are Plus-Plus®, Kapla and Incastro®.

Whereas, the latter type of building blocks may not to a maximum extent challenge the imagination of the child because the set of building blocks already may comprise prefabricated building blocks resembling a window, a door, a roof tile and so on and so forth, the former type to a greater extent challenges the child's imagination, because the individual building blocks does not resemble anything else than a building block and the child himself/herself will have to put the individual blocks together so as to make the combination look like familiar items.

As already mentioned, one example of building blocks of the former type is marketed as Plus-Plus®. This building block comprises a three-dimensional element comprising two vertical bars and one horizontal cross-bar fused into the two vertical bars, wherein each vertical bar, at a position facing away from the horizontal cross-bar, and at a midpoint of that vertical bar, additionally comprises a protrusion having an extension corresponding to ⅓ of the height of one of the vertical bars.

The Plus-Plus® building block thereby comprises a total of six protrusions (two in respect of each vertical bar and the two horizontally protrusions) and two voids (between upper parts of vertical bars and lower parts of the vertical bars, respectively).

As the dimensions of each void is adapted to the dimension of each protrusion, two similar Plus-Plus® building blocks can be put together and held in place solely by virtue of friction by squeezing a protrusion of one building block into a void of another building block.

Accordingly, the fact that the Plus-Plus® building blocks, in themselves, do not resemble any familiar everyday item, allows them to become combined with other similar building blocks so as to create various geometrical shapes, figures, structures or creations.

However, although the Plus-Plus® building block is very simple in its design, yet still allowing to be combined with similar building blocks so as to create various geometrical shapes, figures, structures and creations, the functional features of the Plus-Plus® building block is nevertheless rather restricted, especially in terms of allowing individual building blocks to move in relation to other individual building blocks in a combined creation of Plus-Plus® building blocks.

It is an objective of the present invention to create a toy building block system with improved functionality.

SUMMARY

This objective is fulfilled according to the first, the second and the third aspect of the present invention.

Accordingly, the present invention in its first aspect relates to a toy building block system comprising:

one or more building blocks; and one or more wheels;

wherein each said building block comprises:

a first elongate portion extending in a longitudinal direction X;

a second elongate portion extending in said longitudinal direction X;

an intermediate portion connecting said first elongate portion with said second elongate portion at a middle position thereof;

a first end portion extending in a transverse direction Y, perpendicular to said longitudinal direction X, from said first elongate portion, at a side thereof opposite to said intermediate portion, and at a middle position thereof;

a second end portion extending in said transverse direction Y, perpendicular to said longitudinal direction X, from said second elongate portion, at a side opposite to said intermediate portion, and at a middle position thereof;

said building block thereby comprises six protrusions and two voids, wherein each void is being defined between an end of said first elongate portion and an end of said second elongate portion.

wherein each said wheel comprises:

a hub; and a wheel rim;

wherein said wheel rim is surrounding said hub; and wherein said wheel rim is being attached to said hub in such a way that said wheel rim is configured to be able to swivel around a rotational axis A in relation to said hub;

wherein said hub at a centre thereof comprises a hole extending in an axial direction A; wherein the dimensions and geometry of said hole are adapted to the dimensions and geometry of one of said protrusions of said building block; so as to be able to accommodate said protrusion and thereby hold said protrusion of said building block in place in said hole of said hub solely by friction The present invention in its second aspect relates to a toy building block system comprising:

one or more building blocks; and one or more wheels;

wherein each said building block comprises:

a first elongate portion extending in a longitudinal direction X;

a second elongate portion extending in said longitudinal direction X;

an intermediate portion connecting said first elongate portion with said second elongate portion at a middle position thereof;

a first end portion extending in a transverse direction Y, perpendicular to said longitudinal direction X, from said first elongate portion, at a side thereof opposite to said intermediate portion, and at a middle position thereof;

a second end portion extending in said transverse direction Y, perpendicular to said longitudinal direction X, from said second elongate portion, at a side opposite to said intermediate portion, and at a middle position thereof;

said building block thereby comprises six protrusions and two voids, wherein each void is being defined between an end of said first elongate portion and an end of said second elongate portion.

wherein each said wheel comprises:

a hub; and a wheel rim;

wherein said wheel rim is surrounding said hub; and wherein said wheel rim is being attached to said hub in such a way that said wheel rim is configured to be able to swivel around a rotational axis A in relation to said hub;

wherein said hub at a centre thereof comprises a hole extending in an axial direction A; wherein the dimensions and geometry of said hole are adapted to the dimensions and geometry of one of said protrusions of said building block; so as to be able to accommodate said protrusion and thereby hold said protrusion of said building block in place in said hole of said hub solely by friction;

wherein said toy building block system further comprising a base plate, wherein said base plate comprises an array of holes extending into said plate, said array of holes are arranged at a surface of said plate in two perpendicular directions;

wherein one or more of said holes is/are having dimensions and geometries which are adapted to the dimensions and geometry of one of said protrusions of said building block;

wherein the distance between any two nearest and adjacent holes in said base plate corresponds to the distance, in a transverse direction, between the first elongate portion and the second elongate portion of said building block; so as to be able to accommodate said protrusions and thereby hold said building block in place in said base plate solely via friction.

In a third aspect the present invention relates to a method of activation of children, said method comprises:

i) providing a toy building block system (100) according to the first or to the second aspect of the present invention;

ii) allowing one or more children to play with that system.

The present invention in its various aspects provides for a simple building block system made up a few different component which yet allows a variety of combinations, and thereby in an easy and cost efficient manner, in terms og production cost, will represent a valuable educational and intellectually stimulating toy for children.

DETAILED DESCRIPTION OF EXEMPLARY EMBODIMENTS

A First Aspect

Figure 1A:
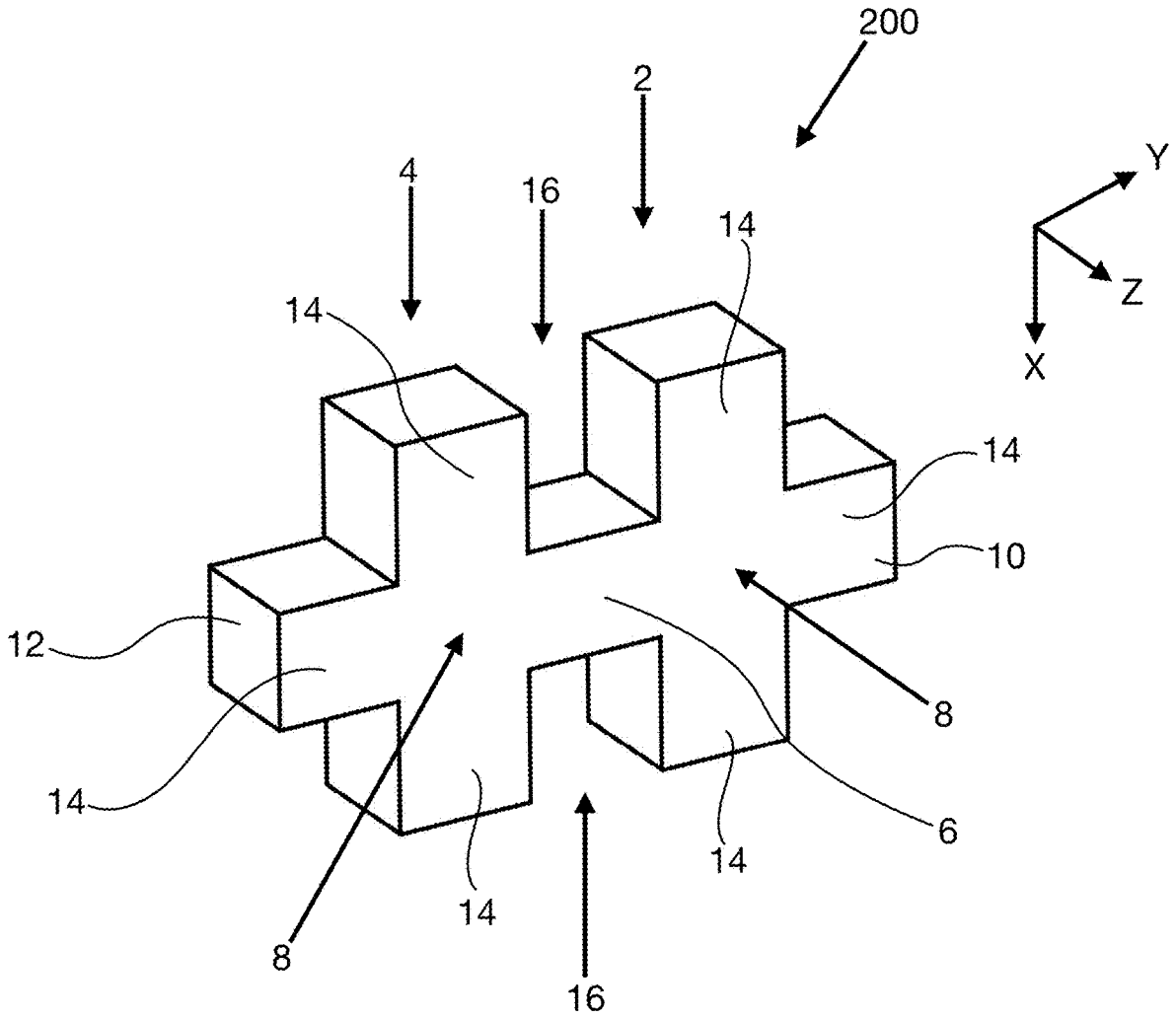
FIG. 1*a* is a perspective view illustrating the prior art toy building block marketed as Plus-Plus®.

The present invention in its first aspect relates to a toy building block system comprising:

one or more building blocks; and one or more wheels;

wherein each said building block comprises:

a first elongate portion extending in a longitudinal direction X;

a second elongate portion extending in said longitudinal direction X;

an intermediate portion connecting said first elongate portion with said second elongate portion at a middle position thereof;

a first end portion extending in a transverse direction Y, perpendicular to said longitudinal direction X, from said first elongate portion, at a side thereof opposite to said intermediate portion, and at a middle position thereof;

a second end portion extending in said transverse direction Y, perpendicular to said longitudinal direction X, from said second elongate portion, at a side opposite to said intermediate portion, and at a middle position thereof;

said building block thereby comprises six protrusions and two voids, wherein each void is being defined between an end of said first elongate portion and an end of said second elongate portion.

wherein each said wheel comprises:

a hub; and a wheel rim;

wherein said wheel rim is surrounding said hub; and wherein said wheel rim is being attached to said hub in such a way that said wheel rim is configured to be able to swivel around a rotational axis A in relation to said hub;

wherein said hub at a centre thereof comprises a hole extending in an axial direction A; wherein the dimensions and geometry of said hole are adapted to the dimensions and geometry of one of said protrusions of said building block; so as to be able to accommodate said protrusion and thereby hold said protrusion of said building block in place in said hole of said hub solely by friction.

The toy building block system according to the first aspect at least comprises two different elements. The first element is in the form of a building block in the form of a fixed structure having no components being able to move in relation to other components.

The other element, on the other hand is in the form of a wheel comprising a hub and a wheel rim which are configured to be able to swivel in relation to each other (by application of an external force, such as by the action of a human hand).

With a plurality of such building blocks and wheels a huge amount of different combinations in the form of different structures can be build.

It should be noted that in the present description and in the appended claims the element of the toy building block system denoted as a "wheel" in general may be considered as a bearing allowing one part of a structure made from the inventive system to rotate in relation to another part of that structure.

In an embodiment of the toy building block system according to the first aspect of the present invention, the distance between the first elongate portion and the second elongate portion, in a transverse direction Y, corresponds to the extension in a longitudinal direction X or to the extension in a height direction Z of said first and/or of said second end portion; said height direction Z being perpendicular to said longitudinal direction X and to said transverse direction Y.

In an embodiment of the toy building block system according to the first aspect of the present invention the intermediate portion is having an extension in said longitudinal direction X of unit size=1; wherein said first end portion is having an extension in said longitudinal direction X of unit size=1; and wherein said first elongate portion is having an extension in said longitudinal direction of unit size=3; and wherein said second elongate portion is having an extension in said longitudinal direction of unit size=3.

In an embodiment of the toy building block system according to the first aspect of the present invention the intermediate portion is having an extension in said transverse direction Y of unit size=1; wherein said first end portion is having an extension in said transverse direction Y of unit size=1; and wherein said first elongate portion is having an extension in said transverse direction Y of unit size=1; and wherein said second elongate portion is having an extension in said longitudinal direction X of unit size=1.

In an embodiment of the toy building block system according to the first aspect of the present invention the intermediate portion is having an extension in a height direction Z of unit size=1; wherein said first end portion is having an extension in said height direction Z of unit size=1; and wherein said first elongate portion is having an extension in said height direction Z of unit size=1; and wherein said second elongate portion is having an extension in said height direction Z of unit size=1; said height direction Z being perpendicular to said longitudinal direction X and to said transverse direction Y.

In an embodiment of the toy building block system according to the first aspect of the present invention the above mentioned unit size is selected from the ranges of 0.2-40 cm, such as 0.4-35 cm, e.g. 0.5-30 cm, such as 1-25 cm, e.g. 2-20 cm, for example 3-18 cm, such as 4-17 cm, for example 5-16 cm, such as 6-15 cm, e.g. 7-14 cm, such as 8-13 cm, 9-12 cm or 10-11 cm.

In an embodiment of the toy building block system according to the first aspect of the present invention the first elongate portion, the second elongate portion, the intermediate portion, the first end portion and the second end portion are being present as an integrated, coherent entity.

In an embodiment of the toy building block system according to the first aspect of the present invention the geometry of the building block is selected in such a way that the building block geometrically is having an outer shape corresponding to nine cubes being fused together to a coherent entity.

In an embodiment of the toy building block system according to the first aspect of the present invention one or more of said building blocks is/are being a toy building block of the type which prior to the priority date of the present patent application has been marketed as a Plus-Plus® toy building block or as a Plus-Plus® MINI toy building block or a Plus-Plus® BIG toy building block.

The above geometries and dimensions of the building block have proven to be appropriate for the intended use.

In an embodiment of the toy building block system according to the first aspect of the present invention the first elongate portion, second elongate portion and the intermediate portion, the first end portion and the second end portion, and thereby said building block is being made from a polymeric material, such as poly ethylene (PE), poly propylene (PP) or acrylonitrile butadiene styrene polymer (ABS);); and/or wherein said wheel rim and/or said hub of said wheel is/are being made from a polymeric material, such as poly ethylene (PE), poly propylene (PP) or acrylonitrile butadiene styrene polymer (ABS).

These materials have proven suitable for use as a toy building block.

In an embodiment of the toy building block system according to the first aspect of the present invention the hole in the hub one or more of said wheels is independently being a through-going hole or a non-through-going hole.

In an embodiment of the toy building block system according to the first aspect of the present invention the wheel rim along an end surface thereof comprises one or more holes extending in an axial direction A; wherein the dimensions and geometry of said one or more holes of said wheel rim is/are adapted to the dimensions and geometry of one or more protrusions of said building block; so as to be able to accommodate and hold said protrusion and thereby said building block in place in said wheel rim solely by friction.

As mentioned, providing such holes in the wheel rim allows for attaching a building block to said hole. Thereby further combinations of putting together elements of the toy building system is possible.

In an embodiment of the toy building block system according to the first aspect of the present invention the wheel rim along an end surface thereof comprises one or more holes extending in an axial direction A; wherein the dimensions of said one or more holes of said wheel rim is/are smaller than the dimensions of the hole in said hub.

Hereby it is possible to attach a building block to said hole in the wheel rim, wherein that specific building block is smaller than a building block having a protrusion which fits the hole in the hub of that wheel. Thereby even further combinations of putting together elements of the toy building system is possible.

In an embodiment of the toy building block system according to the first aspect of the present invention the holes of said wheel rim are arranged in 1, 2, 3, 4 or five groups of 1, 2 or 3 holes, such as in four groups of two holes, wherein said four groups are arranged along said surface of said wheel rim at an equiangular spacing of 90°.

In an embodiment of the toy building block system according to the first aspect of the present invention the distance between two adjacent holes in each group of holes corresponds to the distance, in a transverse direction, between the first elongate portion and the second elongate portion of said building block.

Hereby the two protrusions of the first end portion and the second end portion, respectively can be accommodated in such a pair of holes.

In an embodiment of the toy building block system according to the first aspect of the present invention the wheel rim at a surface facing the axial axis A thereof comprises one or more circular recesses extending into said wheel rim; and wherein said hub at a surface facing away from said axial axis A comprises a corresponding number of protrusions extending away from said axial axis A; wherein the dimensions and geometry of said wheel rim are adapted to the dimensions and geometry of said hub in such a way that said wheel rim is being able to swivel around said hub when said wheel rim is attached to said hub.

In an embodiment of the toy building block system according to the first aspect of the present invention the hub at a surface facing away from the axial axis A thereof comprises one or more circular recesses extending into said hub; and wherein said wheel rim at a surface facing said axial axis comprises a corresponding number of protrusions extending towards said axial axis A; wherein the dimensions and geometry of said wheel rim are adapted to the dimensions and geometry of said hub in such a way that said wheel rim is being able to swivel around said hub when said wheel rim is attached to said hub.

These two embodiments represent simple ways of making the wheel rim swivel around the hub.

In an embodiment of the toy building block system according to the first aspect of the present invention the one or more holes in the wheel rim of one or more wheels is/are a through-going hole or non-through-going hole.

In an embodiment of the toy building block system according to the first aspect of the present invention two or more of said building blocks, preferably all toy building blocks of said system are having similar dimensions.

In an embodiment of the toy building block system according to the first aspect of the present invention the two or more of said building blocks are having different dimensions, such as comprising two or more groups of building blocks, wherein the dimensions of the building blocks of one group is different from the dimensions of the building blocks of another group.

Providing the building blocks in two or more sizes provides for more possible ways of putting together building blocks in the creation of a structure thereof.

In an embodiment of the toy building block system according to the first aspect of the present invention the toy building block system comprises building blocks and/ or wheels of different colours.

A Second Aspect

The present invention in its second aspect relates to a toy building block system comprising:

one or more building blocks; and one or more wheels;

wherein each said building block comprises:

a first elongate portion extending in a longitudinal direction X;

a second elongate portion extending in said longitudinal direction X;

an intermediate portion connecting said first elongate portion with said second elongate portion at a middle position thereof;

a first end portion extending in a transverse direction Y, perpendicular to said longitudinal direction X, from said first elongate portion, at a side thereof opposite to said intermediate portion, and at a middle position thereof;

a second end portion extending in said transverse direction Y, perpendicular to said longitudinal direction X, from said second elongate portion, at a side opposite to said intermediate portion, and at a middle position thereof;

said building block thereby comprises six protrusions and two voids, wherein each void is being defined between an end of said first elongate portion and an end of said second elongate portion.

wherein each said wheel comprises:

a hub; and a wheel rim;

wherein said wheel rim is surrounding said hub; and wherein said wheel rim is being attached to said hub in such a way that said wheel rim is configured to be able to swivel around a rotational axis A in relation to said hub;

wherein said hub at a centre thereof comprises a hole extending in an axial direction A; wherein the dimensions and geometry of said hole are adapted to the dimensions and geometry of one of said protrusions of said building block; so as to be able to accommodate said protrusion and thereby hold said protrusion of said building block in place in said hole of said hub solely by friction;

wherein said toy building block system further comprising a base plate, wherein said base plate comprises an array of holes extending into said plate, said array of holes are arranged at a surface of said plate in two perpendicular directions;

wherein one or more of said holes is/are having dimensions and geometries which are adapted to the dimensions and geometry of one of said protrusions of said building block;

wherein the distance between any two nearest and adjacent holes in said base plate corresponds to the distance, in a transverse direction, between the first elongate portion and the second elongate portion of said building block; so as to be able to accommodate said protrusions and thereby hold said building block in place in said base plate solely via friction.

Providing the toy building system with a base plate allows for putting together elements of the building block system in even more different combinations.

In an embodiment of the toy building block system according to the first aspect of the present invention the base plate is having an extension in a longitudinal direction and an extension in a transverse direction, said longitudinal direction being perpendicular a transverse direction, wherein said array of holes are arranged in said base plate along said longitudinal direction and said transverse direction so as to form a regular pattern of holes.

In an embodiment of the toy building block system according to the first aspect of the present invention the base plate comprises 2-75 holes, such as 5-70, for example 10-65, such as 15-60, for example 20-55, e.g. 25-50, such as 30-45 or 40-45 holes along one or more lines extending in a longitudinal direction.

In an embodiment of the toy building block system according to the first aspect of the present invention the base plate comprises 2-75 holes, such as 5-70, for example 10-65, such as 15-60, for example 20-55, e.g. 25-50, such as 30-45or 40-45 holes along one or more lines extending in a transverse direction.

In an embodiment of the toy building block system according to the first aspect of the present invention the base plate is having an outer perimeter forming a rectangle, such as a square or forming a triangle, a pentagon, a hexagon, a heptagon, an octagon, or forming a circle or forming an oval shape.

In an embodiment of the toy building block system according to the first aspect of the present invention the one or more holes of said base plate independently are being through-going holes or non-through-going holes.

These geometries of the base plate are suitable for use in a toy building system.

In an embodiment of the toy building block system according to the first aspect of the present invention the number of building blocks independently is selected from the ranges 2-1000 or more, such as 5-900, for example 10-800, such as 20-700, e.g. 20-700, such as 30-600,for example 50-500, such as 100-400 or 200-300; and/or wherein the number of wheels independently is selected from the ranges 2-15, such as 3-14, e.g. 4-13, such as 5-12, for example 6-11, such as 7-10 or 8-9; and/or wherein the number of base plate, if being present, independently is selected from the ranges 2-15, such as 3-14, e.g. 4-13, such as 5-12, for example 6-11, such as 7-10 or 8-9.

In an embodiment of the toy building block system according to the first aspect of the present invention the additionally comprises one or more additional building elements, wherein said one or more additional building elements comprises one or more holes, such as one or more through-going holes, wherein said one or more holes is/are having dimensions and a geometry which are adapted to the dimensions of one or more protrusion of said building block; so as to be able to accommodate said protrusion and thereby hold said building block in place in said additional building elements solely by friction.

A Third Aspect

In a third aspect the present invention relates to a method of activation of children, said method comprises:

i) providing a toy building block system (100) according to the first or to the second aspect of the present invention;

ii) allowing one or more children to play with that system.

Referring to the figure in order to better illustrating the present invention, FIG. 1*a* is a perspective view illustrating the prior art toy building block marketed as Plus-Plus®.

FIG. 1*a* shows the prior art toy building block Plus-Plus® 200 which comprises a first elongate portion 2 extending in a longitudinal direction X;

a second elongate portion 4 extending in said longitudinal direction X;

an intermediate portion 6 connecting said first elongate portion 2 with said second elongate portion 4 at a middle position 8 thereof;

a first end portion 10 extending in a transverse direction Y, perpendicular to said longitudinal direction X, from said first elongate portion 2, at a side thereof opposite to said intermediate portion 6, and at a middle position thereof;

a second end portion 12 extending in said transverse direction Y, perpendicular to said longitudinal direction X, from said second elongate portion 4, at a side opposite to said intermediate portion 6, and at a middle position thereof;

said building block thereby comprises six protrusions 14 and two voids 16, wherein each void 16 is being defined between an end of said first elongate portion 2 and an end of said second elongate portion 4.

It is seen in FIG. 1*a* that all the elements 2, 4, 6 and 14 of the toy building block 200 are having the same extension (unit size=1) in a height direction Z, which is perpendicular to the longitudinal direction X and to the transverse direction Y.

It is also seen in FIG. 1*a* that all the elements 2 and 4 are having an extension in the longitudinal direction X of unit size=3, and an extension in the transversal direction Y of unit size=1.

Further, it is seen in FIG. 1*a* that all the elements 6 and 14 are having an extension in the longitudinal direction X of unit size=1, and an extension in the transversal direction Y of unit size=1.

Hereby, the toy building block 200 illustrated in FIG. 1*a* geometrically may be considered as being made up of nice cubes of equal unit size 1 fused together as a single coherent entity. This is illustrated in FIG. 1*b*, in which the dashed lines mark the separation of the imaginary separation lines between individual cubes.

Figure 1B:
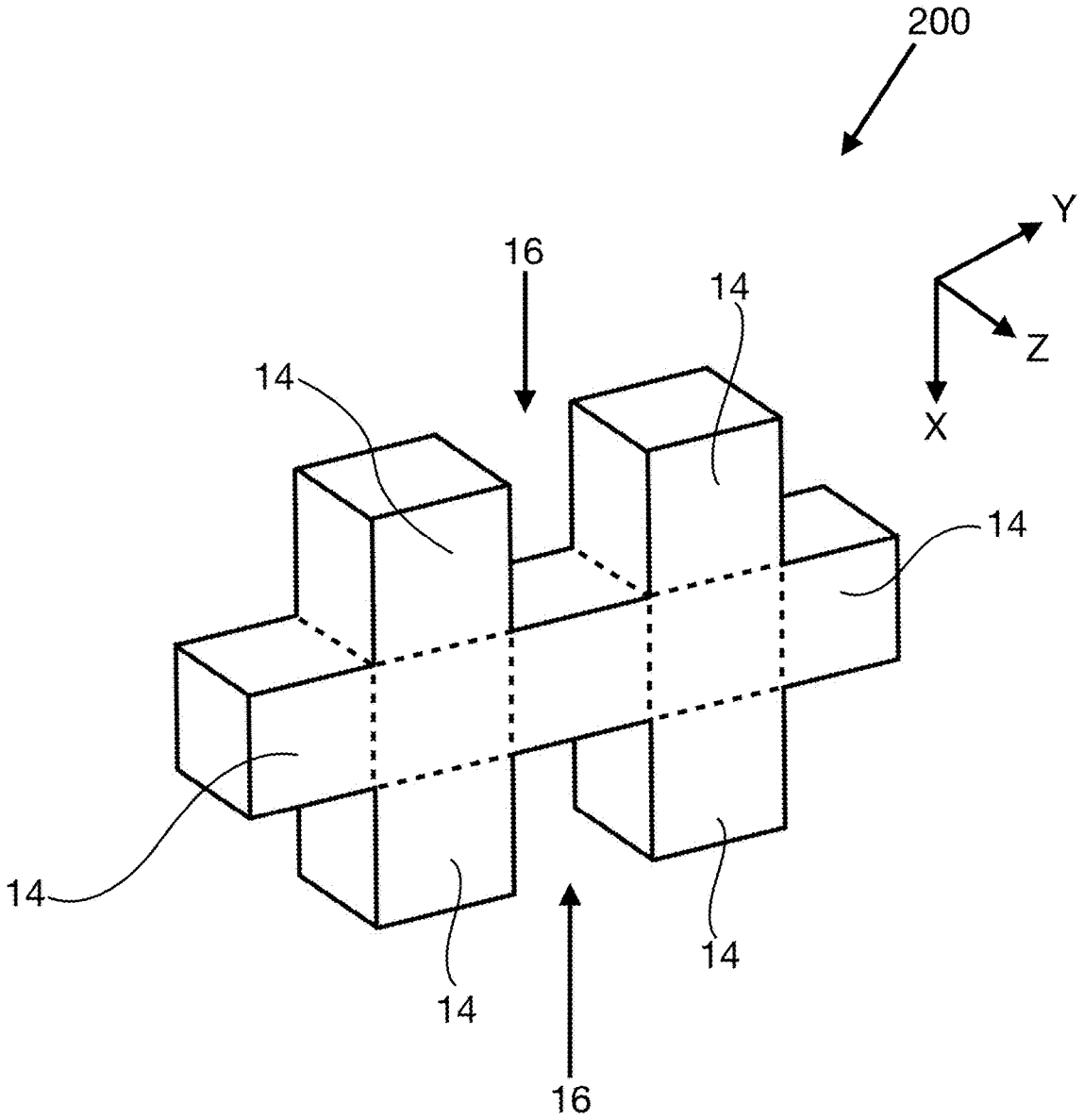
FIG. 1*b* is a perspective view of the toy building block of FIG. 1*a* illustrating that this block can be geometrically considered as constituting nine cubes fused together as an coherent entity.

Accordingly, FIGS. 1*a* and 1*b* shows that the toy building block 200 comprises six protrusions 14 and two voids 16, wherein each void 16 is being defined between an end of said first elongate portion 2 and an end of said second elongate portion 4.

The presence of such protrusions 14 and voids 16 allows for assembling two or more toy building blocks 200 of similar size and geometry in such a way that one protrusion of one building block 200 is accommodated in a void 16 of another building block 200.

Figure 2:
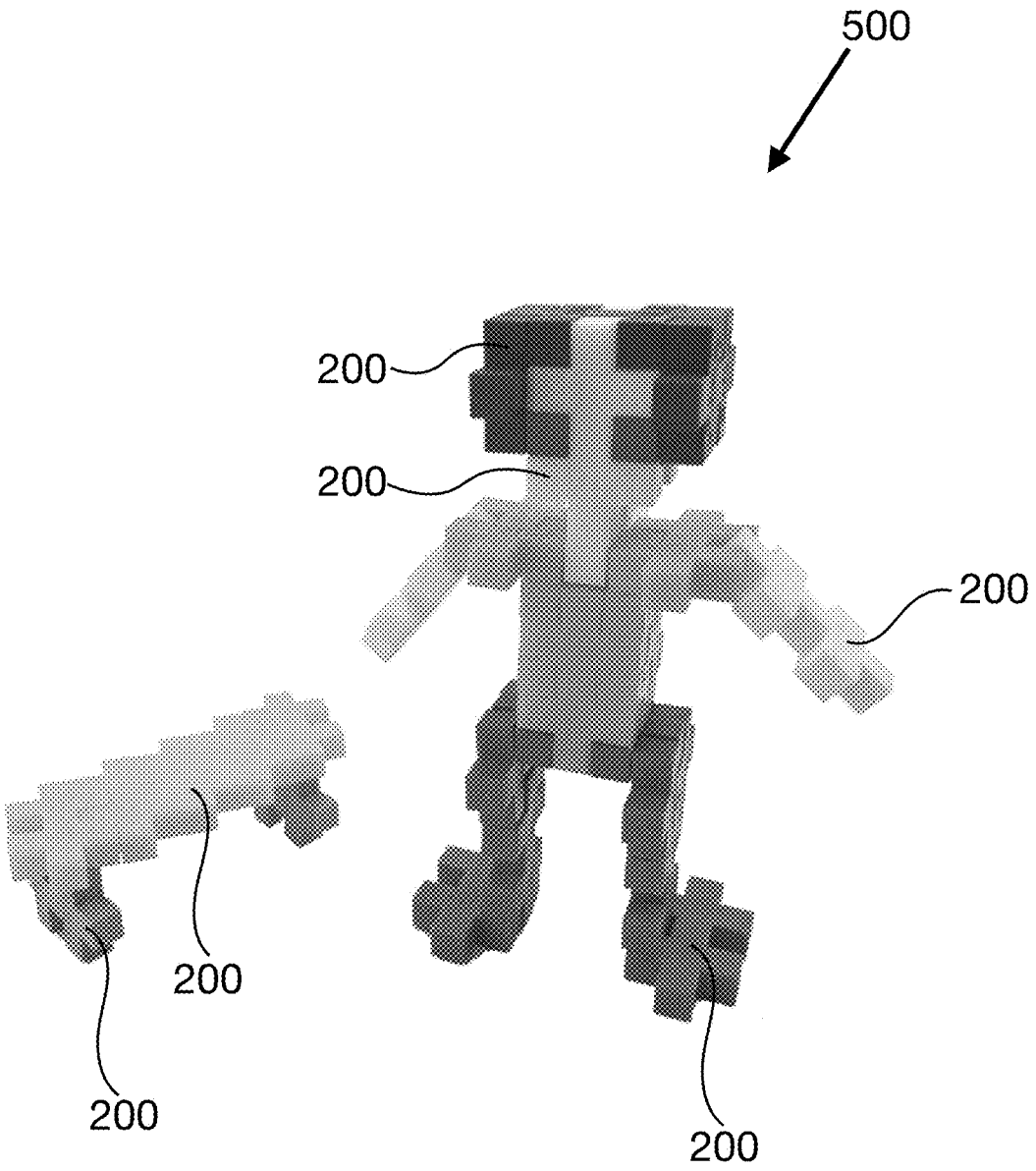
FIG. 2 is a perspective view illustrating a sculpture in the form of a figurine made up of a plurality of the building blocks illustrated in FIG. 1*a*.

This is illustrated in FIG. 2.

FIG. 2 FIG. 2 is a perspective view illustrating a creation in the form of a figurine made up of a plurality of the building blocks illustrated in FIGS. 1*a* and 1*b*.

The figurine illustrated in FIG. 2 resembles a person and a bench.

Figure 3:
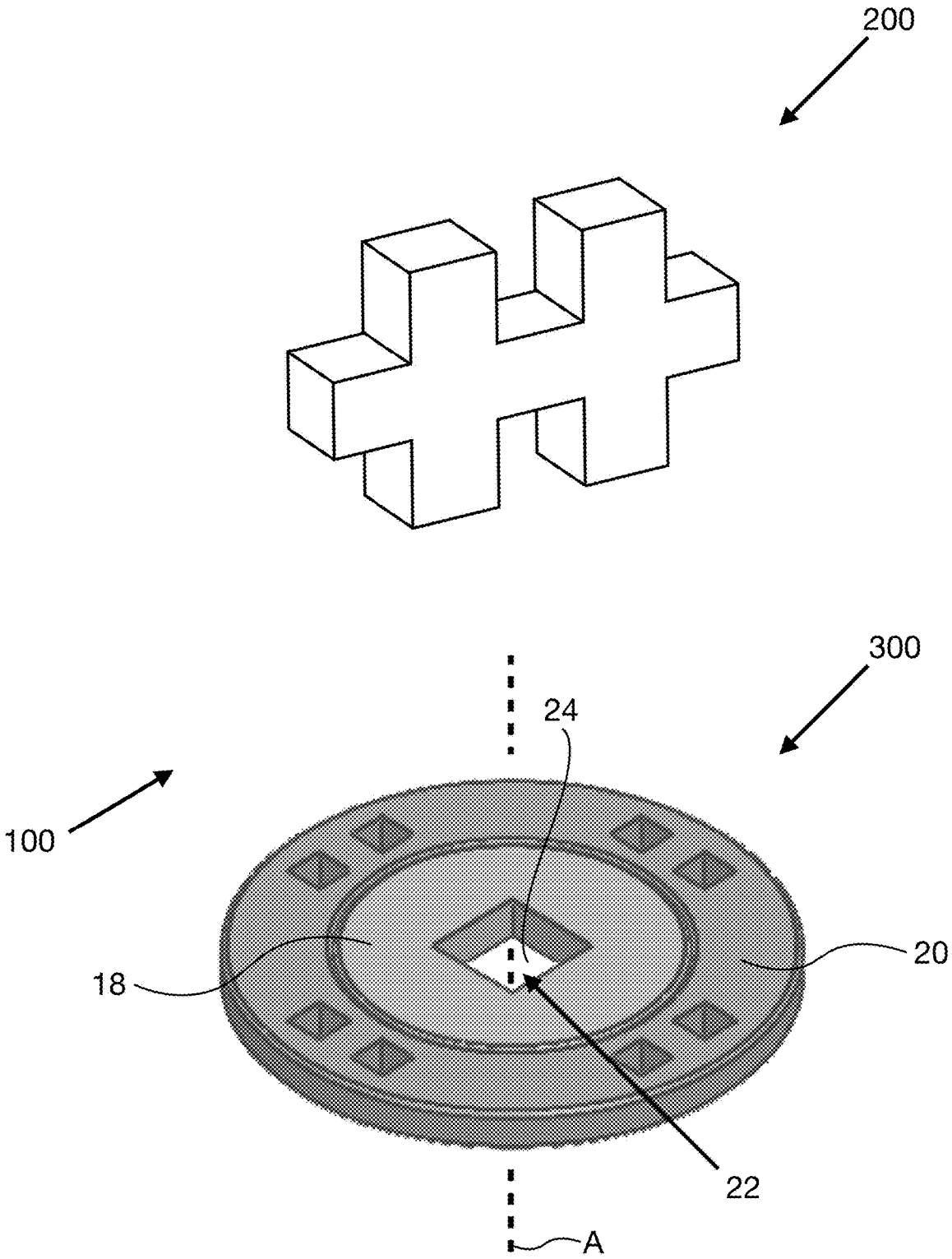
FIG. 3 is a perspective view illustrating a toy building block system according to the first aspect of the present invention comprising the prior art toy building block of FIG. 1*a* in combination with a wheel.

FIG. 3 is a perspective view illustrating a toy building block system according to the first aspect of the present invention comprising the prior art toy building block of FIG. 1*a* in combination with a wheel.

FIG. 3 accordingly shows that the toy building block system 100 comprising the prior art toy building block 200 in combination with a wheel 300.

The building block 200 of the toy building system 100 is as described in respect of the prior art toy building block Plus-Plus® above.

The wheel 300 of the system comprises a hub 18 and a wheel rim 20.

The wheel rim 20 is surrounding the hub 18, and the wheel rim 20 is being attached to the hub 18 in such a way that the wheel rim is configured to be able to swivel around a rotational axis A in relation to the hub 18.

Moreover, the hub 18 at a centre 22 thereof comprises a hole 24 extending in an axial direction A. The dimensions and geometry of the hole 24 are adapted to the dimensions and geometry of one of the protrusions 14 of the building block 200. In this way the hole 24 is able to accommodate the protrusion 14 and thereby hold that protrusion 14 and thereby also the building block 200 in place in said hole 24 of said hub 18 solely by friction.

Accordingly, the toy building block system 100 of the present invention allows for much greater variations in construction of structures made up of the Plus-Plus® building blocks.

Figure 4A:
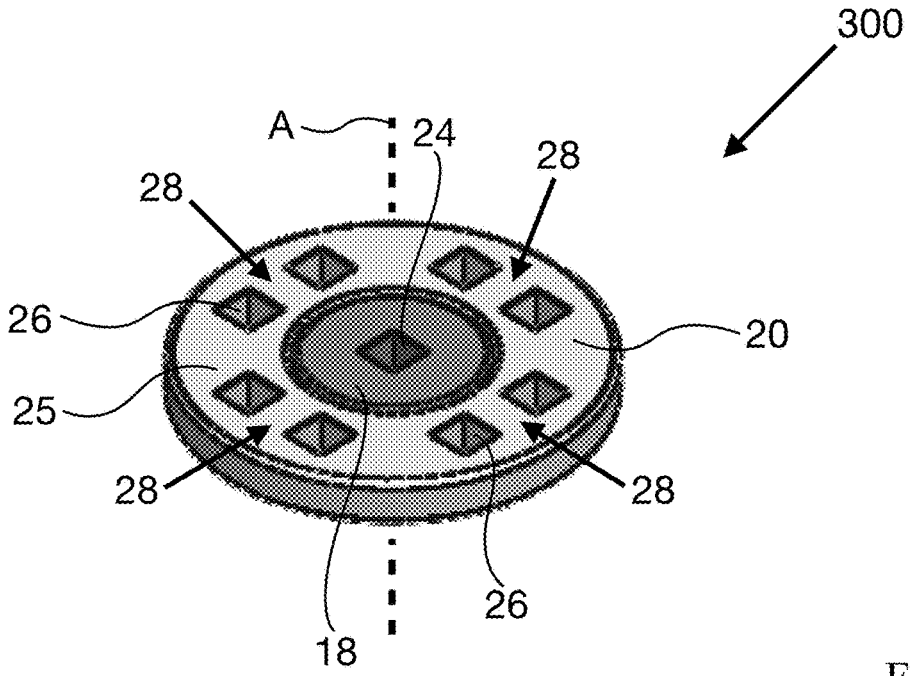
FIGS. 4*a* and 4*b* are perspective views illustrating a wheel of the toy building block system according to the present invention.
Figure 4B:
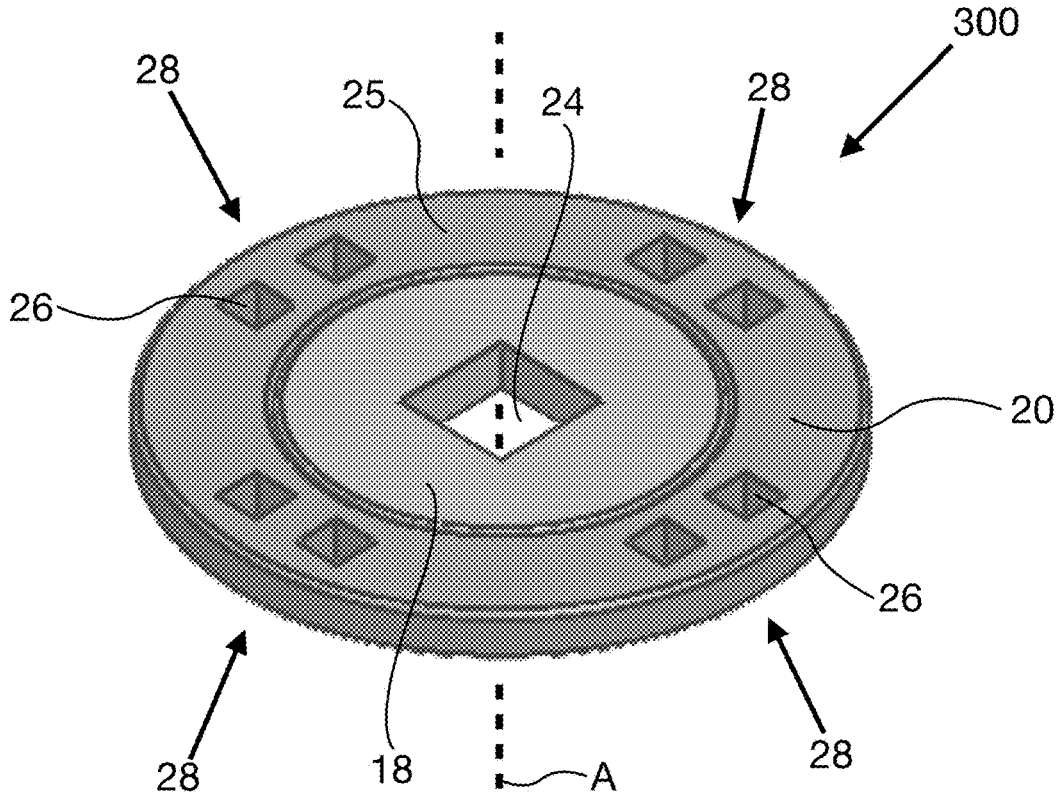

FIGS. 4*a* and 4*b* are perspective views illustrating a wheel of the toy building block system according to the present invention.

Again, it is seen that the wheel comprises a hub 18 and a wheel rim 20.

FIGS. 4*a* and 4*b* shows that the wheel rim 20 along an end surface 25 thereof comprises eight holes 26 extending in an axial direction A.

The dimensions and geometry of the holes 26 of the wheel rim 20 of the wheel 300 illustrated in FIG. 4*a* are adapted to the dimensions and geometry of the one or more protrusions 14 of the building block, and also to the dimensions and geometry of the hole 24 in the hub.

In this way it is possible to accommodate and hold a protrusion 14 of a building block 200 and thereby to hold that building block 200 in place in the wheel rim 20 solely by friction.

An alternative embodiment is shown in FIG. 4*b*. In this embodiment the wheel rim 20 along an end surface 25 thereof also comprises eight holes 26 extending in an axial direction A. However, in this embodiment, the dimensions of these holes 26 of the wheel rim 20 are smaller than the dimensions of the hole 24 in said hub 18 and also smaller than the dimensions of the protrusions 14 of the building block 200.

In this way, the toy building block system 100 may comprise two sizes of building blocks 200, wherein one size of building blocks 200 are adapted, in respect of geometry and dimensions, to be connected to a hub 18 of a wheel 300 via the hole 24 therein, whereas another type of one size of building blocks 200 are adapted, in respect of geometry and dimensions, to be connected to the wheel rim 20 of a wheel 300, in its associated hole 26.

It is seen in FIGS. 4*a* and 4*b* that the eight holes 26 in the wheel rim 20 are arranged in four groups 28 of holes 26, wherein each group 28 comprises two holes 26. The four groups 28 are arranged along the end surface 25 of the wheel rim at an equiangular spacing of 90°.

Figure 5A:
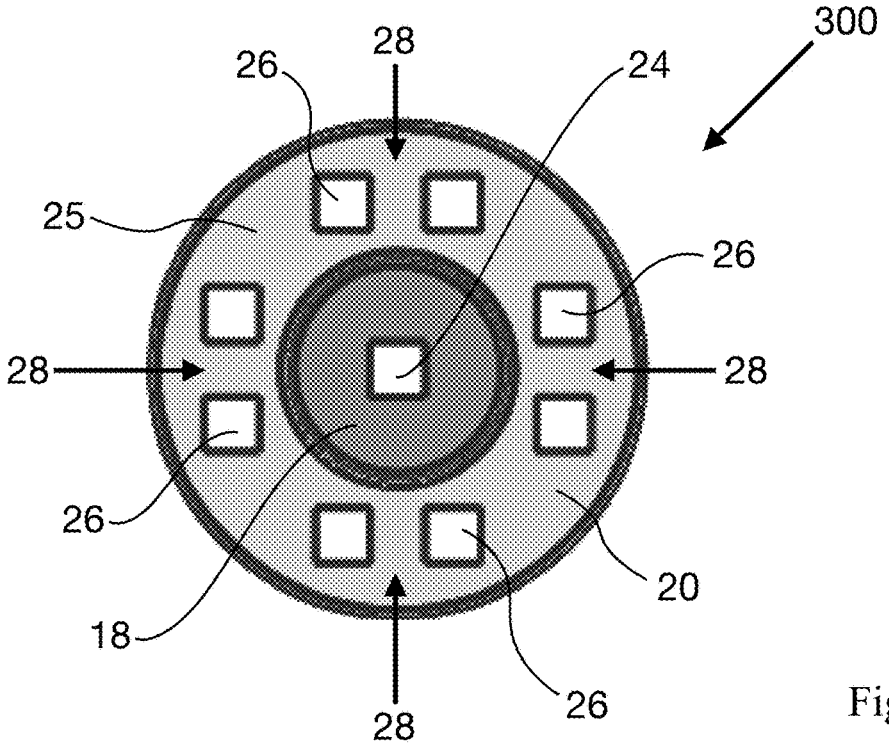
FIGS. 5*a* and 5*b* are plan views illustrating a wheel of the toy building block system according to the present invention.
Figure 5B:
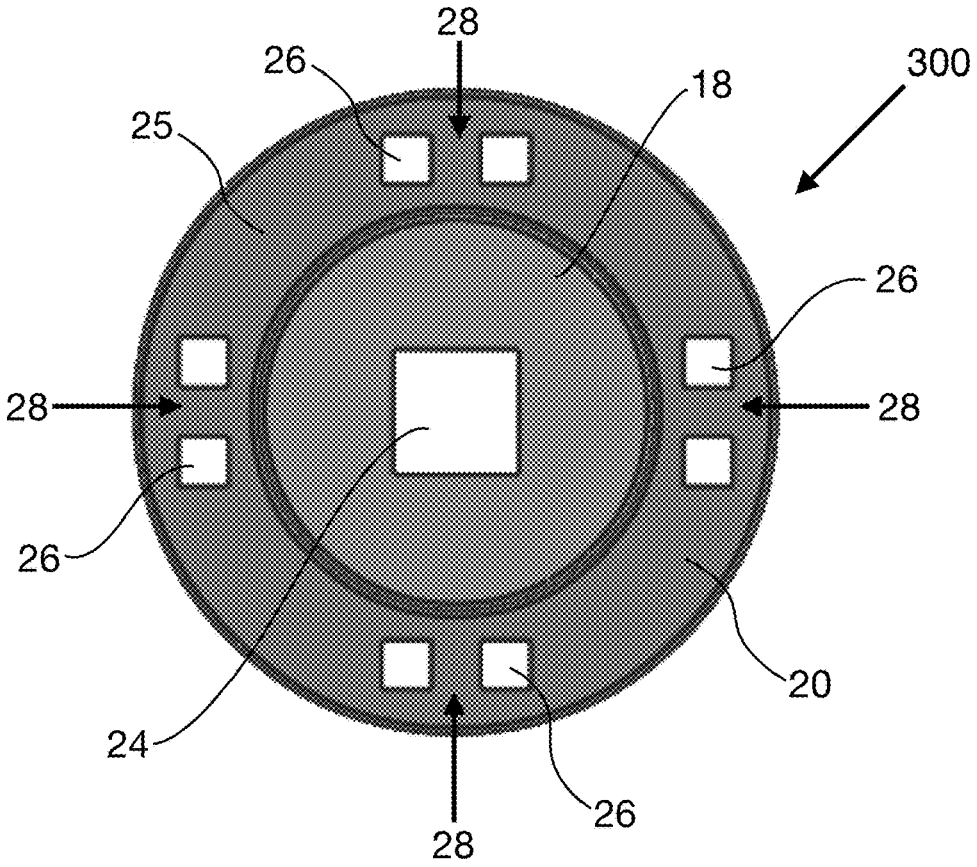

FIGS. 5*a* and 5*b* are plan views illustrating a wheels of FIGS. 4*a* and 4*b*, respectively.

The distance between two adjacent holes 26 in each group 28 of holes corresponds to the distance, in a transverse direction Y, between the first elongate portion 2 and the second elongate portion 4 of the building block 200.

Figure 6A:
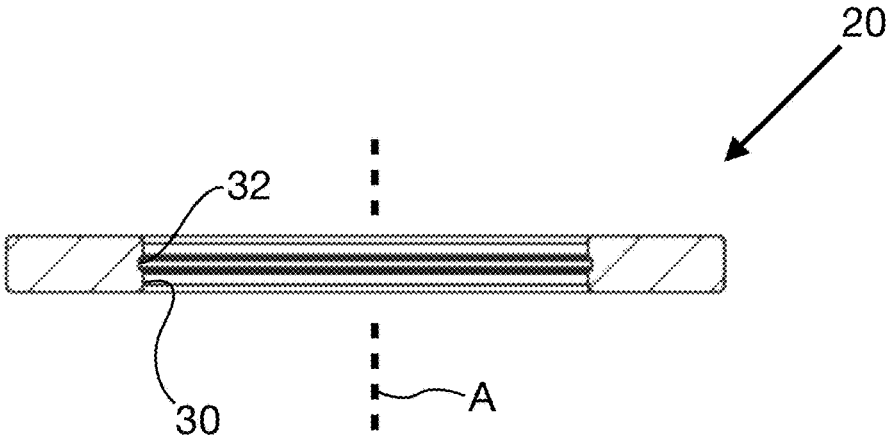
FIGS. 6*a* and 6*b* are cross-sectional views illustrating a wheel rim of a wheel of the toy building block system according to the present invention.
Figure 6B:
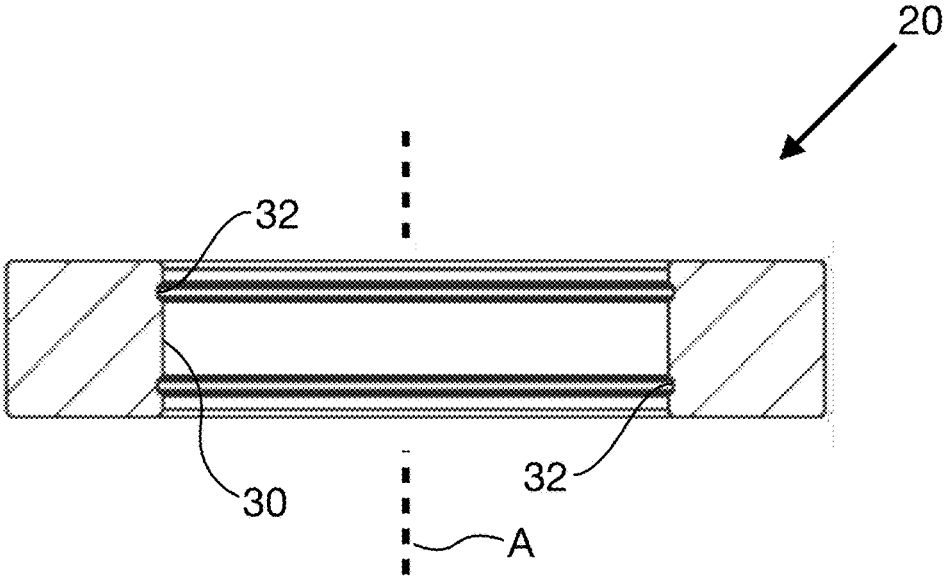

FIGS. 6*a* and 6*b* are cross-sectional views illustrating a wheel rim of a wheel of the toy building block system according to the present invention.

FIG. 6*a* illustrates the wheel rim 20 of the wheel 300 of the toy building block system 100 of the present invention.

FIG. 6*a* shows the wheel rim 20 which at a surface 30 facing the axial axis A thereof comprises a single circular recess 32 extending into the wheel rim 20.

FIG. 6*b* shows an alternative embodiment wherein the wheel rim 20 which at a surface 30 facing the axial axis A thereof comprises two circular recesses 32 extending into the wheel rim 20.

Hereby the hub, when being provided with protrusions which are adapted to enter into engagement with the recess/recesses 32 of the wheel rim 20 can be attached together in a swivelling fashion.

Figure 7:
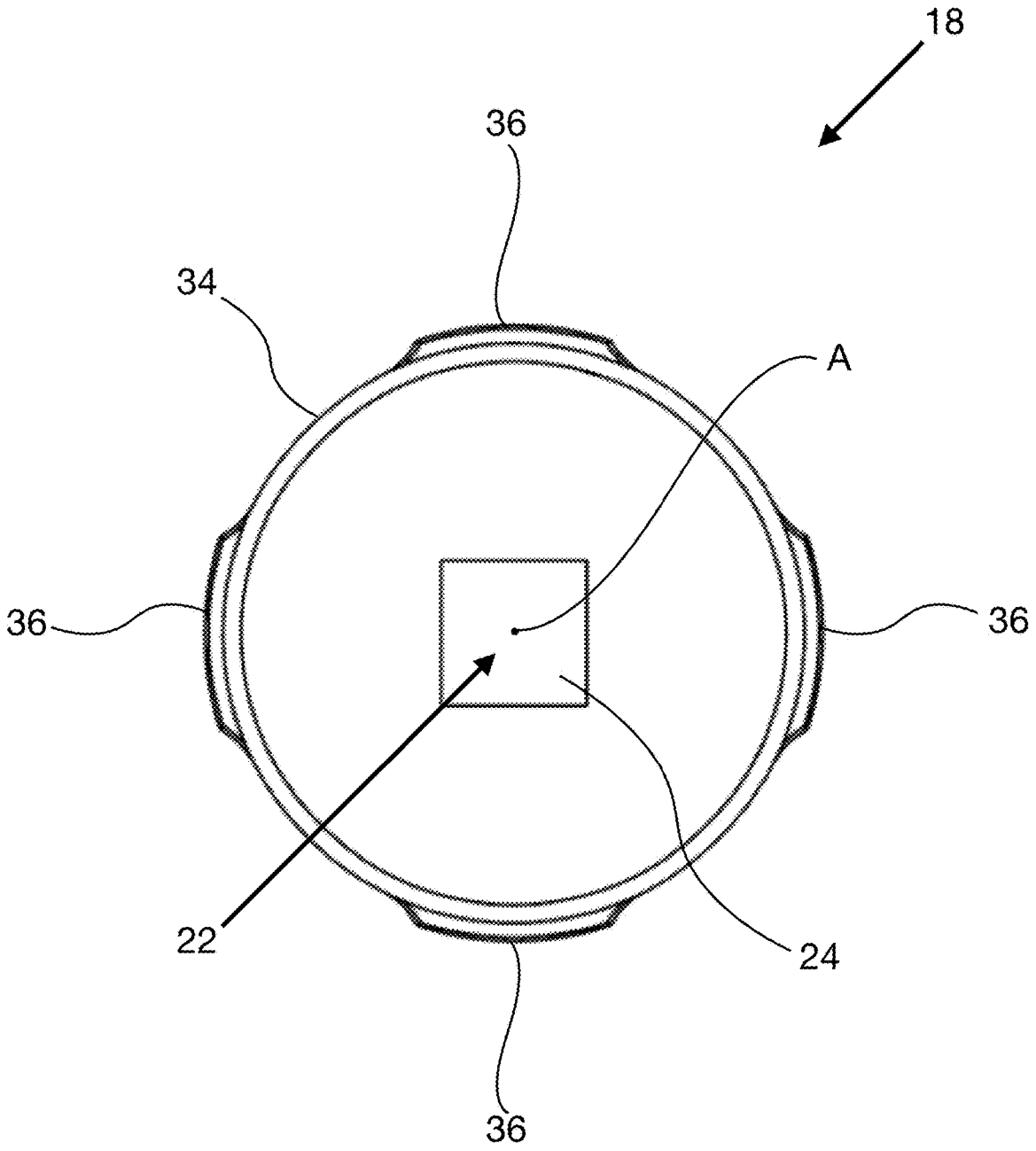
FIG. 7 is a plan view illustrating a hub of a wheel of the toy building block system according to the present invention.

Such a hub is illustrated in FIG. 7.

FIG. 7 is a plan view illustrating a hub of a wheel of the toy building block system according to the present invention.

FIG. 7 shows the hub 18 which at a surface 34 facing away from the axial axis A comprises a protrusion 36 extending away from the axial axis A in a radial direction Accordingly, the dimensions and geometry of the wheel rim 20 with its recess/recesses are adapted to the dimensions and geometry of the hub 18 with its protrusion/protrusions in such a way that the wheel rim 20 is being able to swivel around the hub when the wheel rim 20 is attached to the hub 18.

Designing the wheel rim 20 and the hub 18 in a way illustrated in FIGS. 6*a*, 6*b* and 7 allows the hub 18 and the wheel rim 20 to be simple clicked together in order to achieve the swivelling fashion of attachment.

In an alternative embodiment to the embodiment illustrated in FIGS. 6*a*, 6*b* and 7, the hub 18 at a surface 30 facing away from the axial axis A thereof may comprise one or more circular recesses extending into the hub 18; and the wheel rim 20 at a surface 34 facing said axial axis may comprise a corresponding number of protrusions 36 extending towards the axial axis A in such a way that the dimensions and geometry of the wheel rim 20 with its protrusion(s) are adapted to the dimensions and geometry of the hub 18 with its recess(es) in such a way that the wheel rim is being able to swivel around the hub when the wheel rim 20 is attached to the hub 18 (not illustrated in the figures).

Figure 8:
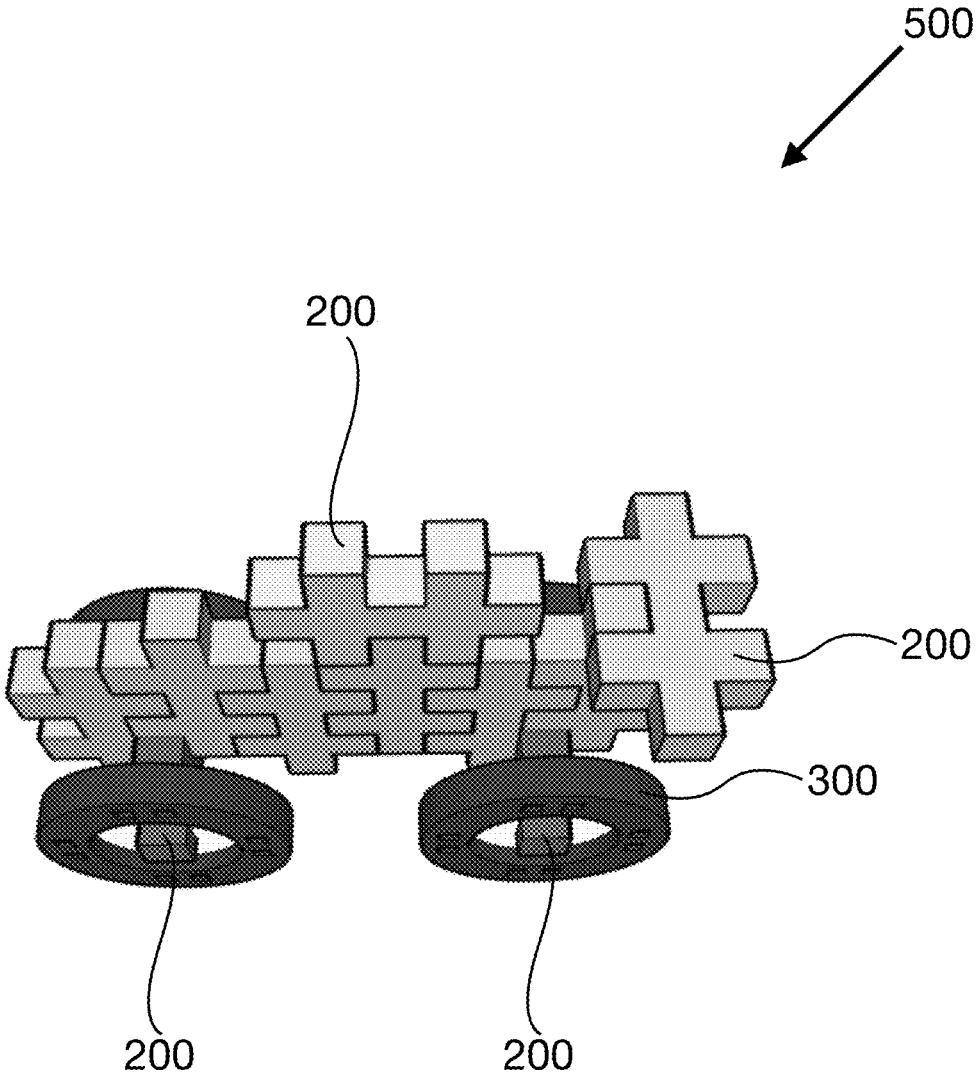
FIG. 8 is a perspective view illustrating a creation made up of a plurality of the building blocks and four wheels according to the present invention.

FIG. 8 is a perspective view illustrating a creation made up of a plurality of the building blocks and four wheels according to the present invention.

Accordingly, FIG. 8 illustrates a toy vehicle 500 according to the toy building block system 100 of the present invention having a body which is made up of a plurality of building blocks 200. The vehicle also comprises four wheels 300.

Each wheel 300 is being attached to the body of the vehicle in that an end portion 10,12 of a building block 200 is arranged in the hole 24 of the hub 18 of that wheel. The remainder of that building block is attached to the body of the vehicle.

Figure 9:
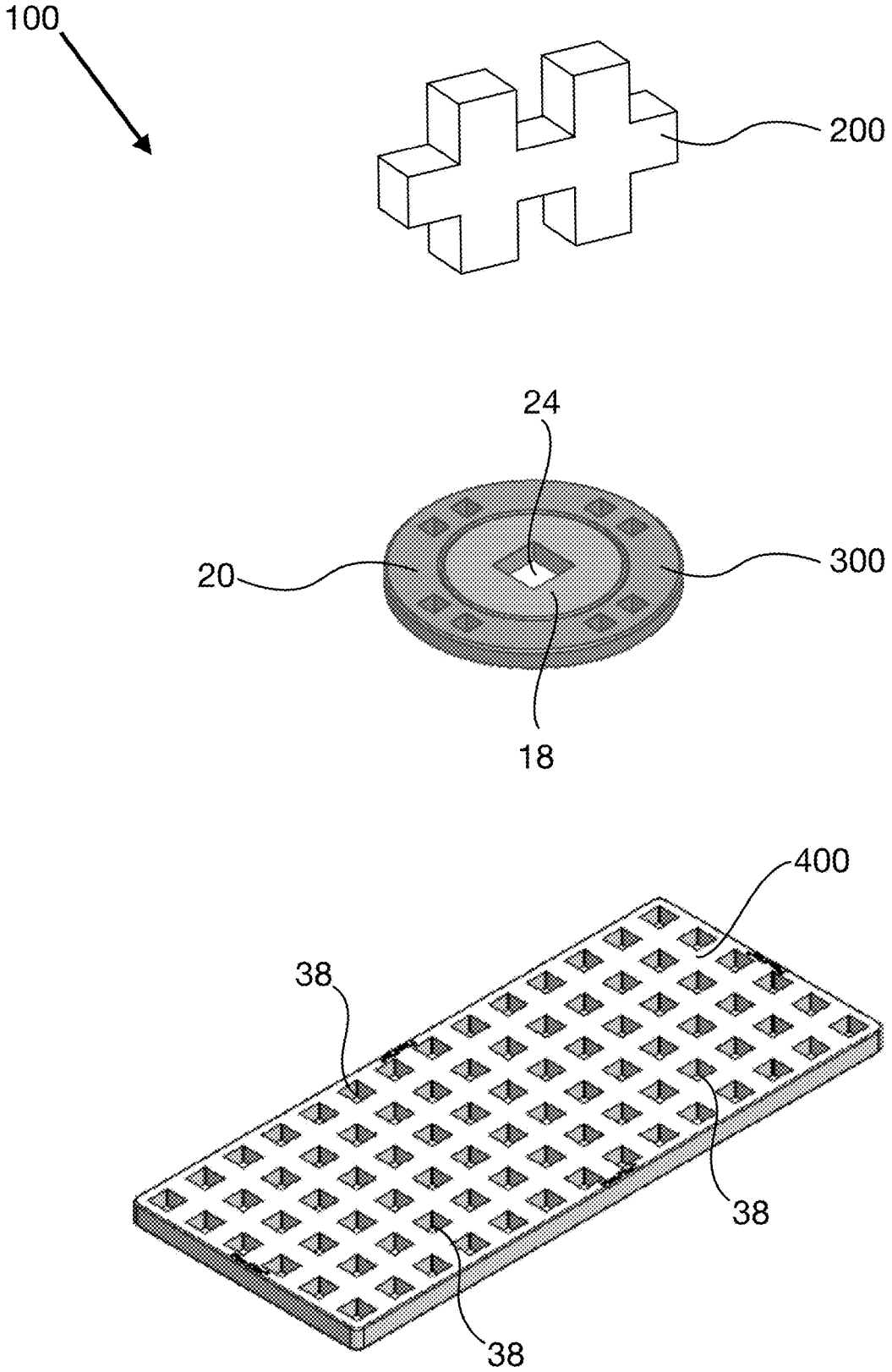
FIG. 9 is a perspective view illustrating a toy building block system according to the second aspect of the present invention comprising the system of FIG. 3 in combination with a base plate.

FIG. 9 illustrates an embodiment of the toy building block system of the second aspect of the present invention.

FIG. 9 shows a toy building block system 100 comprising a building block 200, a wheel 300 and further comprises a base plate 400.

The details of the building block 200 and the wheel 300 are as described above.

The base plate comprises an array of holes 38 extending into the plate 400. The array of holes 38 are arranged at a surface of the plate and extends in two perpendicular directions;

Each of the holes 38 are having dimensions and geometries which are adapted to the dimensions and geometry of one of the protrusions 14 of said building block 200.

Moreover, the distance between any two nearest and adjacent holes 38 in the base plate corresponds to the distance, in a transverse direction, between the first elongate portion 2 and the second elongate portion 4 of the building block 200.

In this way, it is possible to accommodate the protrusions 14 and thereby hold the building block 200 in place in the base plate 400 solely via friction.

FIG. 9 shows that the base plate 400 comprises an array of holes 38 consisting of 6×14 holes, equal to 84 holes thereby being arranged in the base plate along a longitudinal direction and a transverse direction so as to form a regular pattern of holes.

In alternative embodiments the base plate 400 may comprise 2-75 holes or more, such as 5-70, for example 10-65, such as 15-60, for example 20-55, e.g. 25-50, such as 30-45 or 40-45 holes along one or more lines extending in a longitudinal direction and/or in a transversal direction.

The base plate 400 may have any geometrical shape, such as having an outer perimeter forming a rectangle, such as a square or forming a triangle, a pentagon, a hexagon, a heptagon, an octagon, or forming a circle or forming an oval shape.

Figure 10:
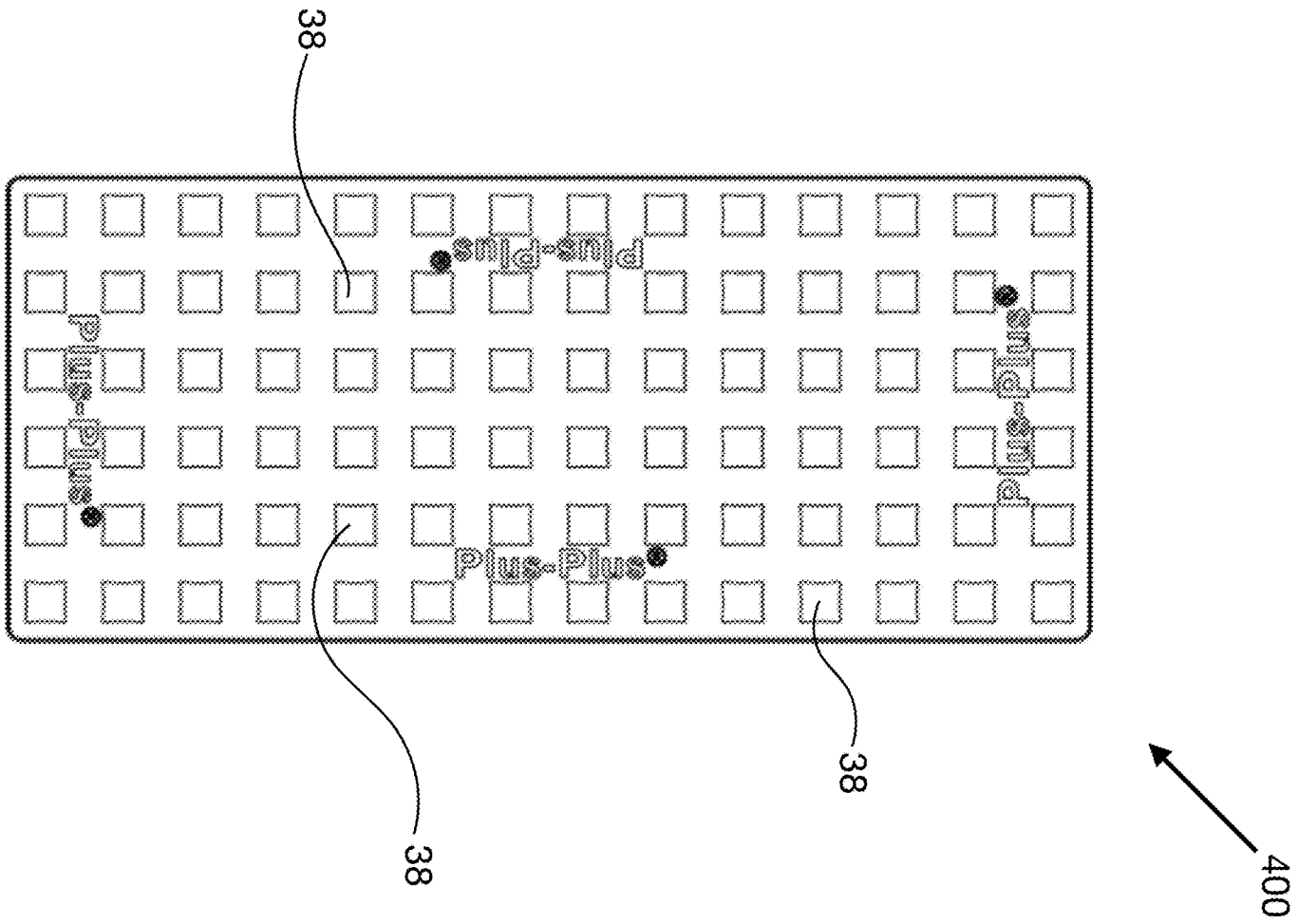
FIG. 10 is a plan view illustrating the base plate of FIG. 9.

FIG. 10 is a plan view illustrating the base plate of FIG. 9.

Incorporating a base plate 400 into the toy building block system 100 of the present invention enhances the number of combinations of putting together various elements of the toy building system 100 of the invention.

Figure 11:
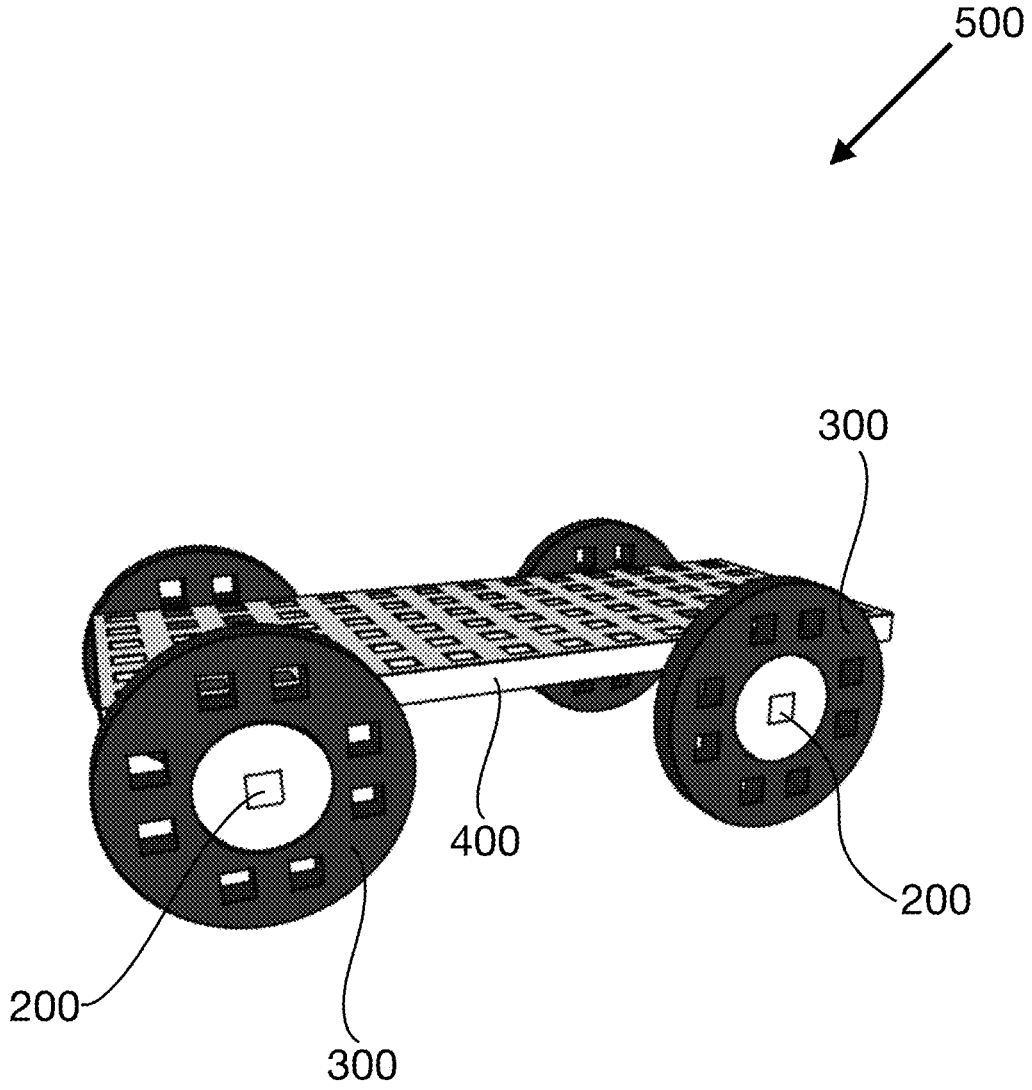
FIG. 11 is a perspective view illustrating a creation in the form of a toy vehicle made up of a plurality of the building blocks and four wheels and a base plate according to the present invention.

An example is illustrated in FIG. 11.

FIG. 11 is a perspective view illustrating a creation in the form of a toy vehicle made up of a plurality of the building blocks and four wheels and a base plate according to the present invention.

Accordingly, FIG. 11 illustrates a toy vehicle 500 according to the toy building block system 100 of the present invention having a chassis which is made up of a base plate 400. The vehicle also comprises four wheels 300 which are being attached via their respective hub hole 24 to a building block 200 which in turn is being attached to the base plate 400.

It should be understood that all features and achievements discussed above and in the appended claims in relation to one aspect of the present invention and embodiments thereof apply equally well to the other aspects of the present invention and embodiments thereof.

LIST OF REFERENCE NUMERALS

2 First elongate portion of building block
4 Second elongate portion of building block
6 Intermediate portion connecting first and second elongate portion
8 Middle portion of first and second elongate portion
10 First end portion
12 Second end portion
14 Protrusion
16 Void between protrusions of first and second elongate portion
18 Hub
20 Wheel rim
22 Centre of hub
24 Centre hole in hub
25 End surface of wheel rim
26 Hole in wheel rim
28 Group of holes in wheel rim
30 Surface of wheel rim facing the axial axis of wheel
32 Circular recess of wheel rim
34 Surface of hub facing away from axial axis of wheel
36 Protrusion of hub, extending away from axial axis of wheel
38 Hole in base plate
100 Toy building block system
200 Toy building block
300 Wheel
400 Base plate
500 Creation
A Rotational axis of wheel
X Longitudinal direction
Y Transverse direction
Z Height direction That which is claimed is:

1. A toy building block system comprising:

one or more building blocks; and one or more wheels;

wherein each of said one or more building blocks comprises a first elongate portion extending in a longitudinal direction (X);

a second elongate portion extending in said longitudinal direction (X);

an intermediate portion connecting said first elongate portion with said second elongate portion at a middle position thereof;

a first end portion extending in a transverse direction (Y) perpendicular to said longitudinal direction (X), from said first elongate portion, at a side thereof opposite to said intermediate portion, and at a middle position thereof;

a second end portion extending in said transverse direction perpendicular to said longitudinal direction (X), from said second elongate portion, at a side opposite to said intermediate portion, and at a middle position thereof;

said building block thereby comprises six protrusions and two voids, wherein each void is defined between an end of said first elongate portion and an end of said second elongate portion;

wherein each of said one or more wheels comprises a hub; and a wheel rim;

wherein said wheel rim surrounds said hub, and wherein said wheel rim is attached to said hub in such a way that said wheel rim is configured to be able to swivel around a rotational axis in relation to said hub;

wherein said hub at a center thereof comprises a hole extending in an axial direction, wherein the dimensions and geometry of said hole are adapted to the dimensions and geometry of one of said protrusions of said building block so as to be able to accommodate said protrusion and thereby hold said protrusion of said building block in place in said hole of said hub solely by friction;

wherein said wheel rim comprises an end surface along which comprises one or more holes extending in an axial direction; and wherein the dimensions and geometry of said one or more holes of said wheel rim are adapted to the dimensions and geometry of one or more protrusions of said building block, so as to be able to accommodate and hold said protrusion and thereby said building block in place in said wheel rim solely by friction.

2. A toy building block system according to claim 1, wherein the distance between the first elongate portion and the second elongate portion, in a transverse direction (Y), corresponds to the extension in a longitudinal direction (X) or to the extension in a height direction (Z) of said first and/or of said second end portion, said height direction (Z) being perpendicular to said longitudinal direction (X) and to said transverse direction (Y).

3. A toy building block system according to claim 1, wherein:

said intermediate portion has an extension in said longitudinal direction (X) of unit size=1;

said first end portion has an extension in said longitudinal direction (X) of unit size=1;

said first elongate portion has an extension in said longitudinal direction (X) of unit size=3; and said second elongate portion has an extension in said longitudinal direction (X) of unit size=3.

4. A toy building block system according to claim 3, wherein said unit size is in the range of 0.2- 40 cm, optionally 0.4-35 cm, optionally 0.5-30 cm, optionally 1-25 cm, optionally 2-20 cm, optionally 3-18 cm, optionally 4-17 cm, optionally 5-16 cm, optionally 6-15 cm, optionally 7-14 cm, optionally 8-13 cm, optionally 9-12 cm, and optionally 10-11 cm.

5. A toy building block system according to claim 1, wherein:

said intermediate portion has an extension in said transverse direction (Y) of unit size=1;

said first end portion has an extension in said transverse direction (Y) of unit size=1;

said first elongate portion has an extension in said transverse direction (Y) of unit size=1; and said second elongate portion has an extension in said longitudinal direction (X) of unit size=1.

6. A toy building block system according to claim 1, wherein:

said intermediate portion has an extension in a height direction (Z) of unit size=1;

said first end portion has an extension in said height direction (Z) of unit size=1;

said first elongate portion has an extension in said height direction (Z) of unit size=1; and said second elongate portion has an extension in said height direction (Z) of unit size=1, said height direction (Z) being perpendicular to said longitudinal direction (X) and to said transverse direction (Y).

7. A toy building block system according to claim 1, wherein said first elongate portion, said second elongate portion, said intermediate portion, said first end portion, and said second end portion are an integrated, coherent entity.

8. A toy building block system according to claim 1, wherein the geometry of said building block is selected in such a way that said building block geometrically has an outer shape corresponding to nine cubes being fused together to form a coherent entity.

9. A toy building block system according to claim 1, wherein one or more of said building blocks is a toy building block.

10. A toy building block system according to claim 1, wherein:

said wheel rim comprises an end surface along which comprises one or more holes extending in an axial direction; and wherein the dimensions of said one or more holes of said wheel rim are smaller than the dimensions of the hole in said hub.

11. A toy building block system according to claim 1, wherein:

said holes of said wheel rim are arranged in 1, 2, 3, 4, or 5 groups of 1, 2, or 3 holes, optionally in four groups of two holes; and said four groups are arranged along said surface of said wheel rim at an equiangular spacing of 90°.

12. A toy building block system according to claim 11, wherein the distance between two adjacent holes in each group of holes is the same distance, in a transverse direction, as the distance between the first elongate portion and the second elongate portion of said building block.

13. A toy building block system according to claim 1, wherein:

said wheel rim comprises a surface facing the axial axis (A) thereof which comprises one or more circular recesses extending into said wheel rim;

wherein said hub at a surface facing away from said axial axis (A) comprises a number of protrusions the same as the number of said one or more circular recesses, said protrusions extending away from said axial axis (A); and the dimensions and geometry of said wheel rim are adapted to the dimensions and geometry of said hub in such a way that said wheel rim is able to swivel around said hub when said wheel rim is attached to said hub.

14. A toy building block system according to claim 1, wherein:

said hub comprises a surface facing away from the axial axis thereof which comprises one or more circular recesses extending into said hub;

said wheel rim comprises a surface facing said axial axis which comprises a number of protrusions the same as the number of said one or more circular recesses, said protrusions extending towards said axial axis (A); and the dimensions and geometry of said wheel rim are adapted to the dimensions and geometry of said hub in such a way that said wheel rim is able to swivel around said hub when said wheel rim is attached to said hub.

15. A toy building block system according to claim 1, wherein at least two of said building blocks of said system have similar dimensions.

16. A toy building block system according claim 1, wherein two or more of said building blocks have different dimensions, optionally two or more groups of building blocks in which the dimensions of the building blocks of one group is different from the dimensions of the building blocks of another group.

17. A method of activation of children, said method comprising:

i) providing a toy building block system according to claim 1; and ii) allowing one or more children to play with said toy building block system.

18. A toy building block system, wherein said building block system comprises:

one or more building blocks; and one or more wheels;

wherein each said building block comprises a first elongate portion extending in a longitudinal direction (X), a second elongate portion extending in said longitudinal direction (X), an intermediate portion connecting said first elongate portion with said second elongate portion at a middle position thereof, a first end portion extending in a transverse direction (Y) perpendicular to said longitudinal direction (X), from said first elongate portion, at a side thereof opposite to said intermediate portion, and at a middle position thereof, a second end portion extending in said transverse direction (Y) perpendicular to said longitudinal direction (X), from said second elongate portion, at a side opposite to said intermediate portion, and at a middle position thereof, said building block thereby comprises six protrusions and two voids, wherein each void is defined between an end of said first elongate portion and an end of said second elongate portion;

wherein each said wheel comprises a hub and a wheel rim;

wherein said wheel rim surrounds said hub;

wherein said wheel rim is attached to said hub in such a way that said wheel rim is configured to swivel around a rotational axis (A) in relation to said hub;

wherein said hub at a center thereof comprises a hole extending in an axial direction (A);

wherein the dimensions and geometry of said hole are adapted to the dimensions and geometry of one of said protrusions of said building block, so as to be able to accommodate said protrusion and thereby hold said protrusion of said building block in place in said hole of said hub solely by friction;

wherein said wheel rim comprises an end surface along which comprises one or more holes extending in an axial direction; and wherein the dimensions and geometry of said one or more holes of said wheel rim are adapted to the dimensions and geometry of one or more protrusions of said building block, so as to be able to accommodate and hold said protrusion and thereby said building block in place in said wheel rim solely by friction;

a base plate comprising an array of holes extending into said base plate, said array of holes being arranged at a surface of said plate in two perpendicular directions;

wherein one or more of said holes has dimensions and geometries which are adapted to the dimensions and geometry of one of said protrusions of said building block; and wherein the distance between any two nearest and adjacent holes in said base plate is the same as the distance, in a transverse direction, between the first elongate portion and the second elongate portion of said building block, so as to be able to accommodate said protrusions and thereby hold said building block in place in said base plate solely via friction.

19. A toy building block system according to claim 18, wherein said base plate has an outer perimeter forming a shape, said shape selected from the group consisting of a rectangle, a square, a triangle, a pentagon, a hexagon, a heptagon, an octagon, a circle, and an oval.

* * * * *